US009528345B2

(12) United States Patent
Smith et al.

(10) Patent No.: US 9,528,345 B2
(45) Date of Patent: Dec. 27, 2016

(54) HYDRAULIC COMMUNICATION DEVICE

(71) Applicant: Weatherford Technology Holdings, LLC, Houston, TX (US)

(72) Inventors: Roddie R. Smith, Katy, TX (US); Paul L. Smith, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 319 days.

(21) Appl. No.: 13/766,433

(22) Filed: Feb. 13, 2013

(65) Prior Publication Data

US 2014/0224503 A1 Aug. 14, 2014

(51) Int. Cl.
*E21B 33/12* (2006.01)
*E21B 34/10* (2006.01)

(52) U.S. Cl.
CPC ..... *E21B 34/10* (2013.01)

(58) Field of Classification Search
CPC ..... E21B 23/04; E21B 34/08; E21B 34/10; E21B 34/102; E21B 47/18; F16L 55/11; F16L 55/136; F16K 17/042
USPC ..... 166/373, 192
See application file for complete search history.

(56) References Cited

U.S. PATENT DOCUMENTS 1,830,817 A * 11/1931 Voorhies et al. ..... 138/90
2,949,930 A * 8/1960 Moore, Jr. et al. ..... 137/516.29
3,027,914 A * 4/1962 Jones ..... F16K 15/06 137/515.7
3,097,699 A * 7/1963 Orr ..... E21B 33/146 166/289
4,173,256 A * 11/1979 Kilgore ..... 166/324
4,178,960 A * 12/1979 Napolitano et al. ..... 137/494
4,951,753 A 8/1990 Eriksen
5,435,455 A * 7/1995 Pruss ..... F16L 55/11 220/787
5,810,083 A 9/1998 Kilgore
6,142,237 A * 11/2000 Christmas et al. ..... 166/376
2003/0155131 A1 8/2003 Vick
2005/0274528 A1 12/2005 Hiron et al.
2007/0215352 A1* 9/2007 Shaw ..... E21B 33/1208 166/292
2007/0215358 A1* 9/2007 Messick ..... E21B 43/123 166/372
2009/0008102 A1* 1/2009 Anderson et al. ..... 166/373
2012/0192980 A1 8/2012 Williams

OTHER PUBLICATIONS

PCT International Search Report and Written Opinion for Application PCT/US2014/016306, dated Jun. 23, 2014.

* cited by examiner

*Primary Examiner* — Taras P Bemko
(74) *Attorney, Agent, or Firm* — Patterson & Sheridan LLP

(57) ABSTRACT

The present invention generally relates to a hydraulic communication device that is used in a wellbore for fluid communication during a wellbore operation. In one aspect, a hydraulic communication device is provided. The hydraulic communication device includes a body having a central passageway and a bore formed in a wall of the body. The bore is in fluid communication with the central passageway, and the bore is configured to receive an end of a control line. The hydraulic communication device further includes a plug assembly disposed in the bore formed in the wall of the body. The plug assembly is movable from a first position in which fluid communication through the bore is blocked and a second position in which fluid communication through the bore is unblocked.

22 Claims, 4 Drawing Sheets

HYDRAULIC COMMUNICATION DEVICE

BACKGROUND OF THE INVENTION

Field of the Invention

Embodiments of the present invention generally relate to a wellbore tool. More particularly, the invention relates to a hydraulic communication device.

Description of the Related Art

A safety valve landing nipple and a deep set injection nipple are examples of a hydraulic communication device. Generally, the hydraulic communication device is used in a wellbore for fluid communication during a wellbore operation. The hydraulic communication device is connected to the surface of the wellbore by a control line. The control line is used to provide hydraulic control to a subsurface safety valve in the safety valve landing nipple or to provide chemicals to the deep set injection nipple.

The hydraulic communication device may not be used immediately after it is disposed on a tubing and placed in the wellbore and thus closing off the hydraulic communication device is preferred until the hydraulic communication device is needed. To open the hydraulic communication device, typically a wireline tool is run through the tubing to a position adjacent the hydraulic communication area of the device. Thereafter, the wireline tool is activated to shift a sleeve to create the communication, or the wireline tool performs a cut or punch into a cavity of the hydraulic communication device, which opens fluid communication between the control line and the hydraulic communication device. The use of the wireline tool can be expensive, risky and time consuming. Therefore, there is a need for a hydraulic communication device that can be opened without the use of the wireline tool.

SUMMARY OF THE INVENTION

The present invention generally relates to a hydraulic communication device that is used in a wellbore for fluid communication during a wellbore operation. In one aspect, a hydraulic communication device is provided. The hydraulic communication device includes a body having a central passageway, and a bore formed in a wall of the body. The bore is in fluid communication with the central passageway, and the bore is configured to receive an end of a control line. The hydraulic communication device further includes a plug assembly disposed in the bore formed in the wall of the body. The plug assembly is movable from a first position in which fluid communication through the bore is blocked, and a second position in which fluid communication through the bore is unblocked.

In another aspect, a method of activating a hydraulic communication device in a wellbore is provided. The hydraulic communication device is attached to a control line. The method includes the step of placing the hydraulic communication device in the wellbore. The hydraulic communication device includes a body with a central passageway. The method further includes the step of closing fluid communication between the control line and the central passageway by placing a plug assembly therebetween. The method also includes the step of opening fluid communication between the control line and the central passageway by moving the plug assembly. Additionally, the method includes the step of pumping fluid through the control line, and into the central passageway of the body of the hydraulic communication device.

In a further aspect, a plug assembly is provided. The plug assembly is used with a hydraulic communication device that is attached to a control line. The plug assembly includes a stem portion having a first end and a second end. The plug assembly further includes a head portion attached to the first end of the stem portion. Additionally, the plug assembly includes a seal member disposed around the first end of the stem portion. The seal member is configured to block fluid flow through the control line when the plug assembly is partially disposed within the control line.

In yet another aspect, a method of activating a hydraulic communication device in a wellbore is provided. The method includes the step of attaching a control line to the hydraulic communication device. The method also includes the step of placing the hydraulic communication device in the wellbore. The hydraulic communication device includes a body with a central passageway. The method further includes the step of positioning a plug assembly to block fluid communication between the control line and the central passageway. The method also includes the step of moving the plug assembly to open fluid communication between the control line and the central passageway. Additionally, the method includes the step of pumping fluid through the control line and into the central passageway of the body of the hydraulic communication device.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to a hydraulic communication device that is used in a wellbore for fluid communication. The hydraulic communication device is connected to the surface of the wellbore by a control line. The hydraulic communication device will be described herein in relation to a safety valve landing nipple. It is to be understood, however, that the hydraulic communication device may also be used with other types of nipples, such as a deep set injection nipple, without departing from principles of the present invention. To better understand the novelty of the hydraulic communication device of the present invention and the methods of use thereof, reference is hereafter made to the accompanying drawings.

Figure 1A:
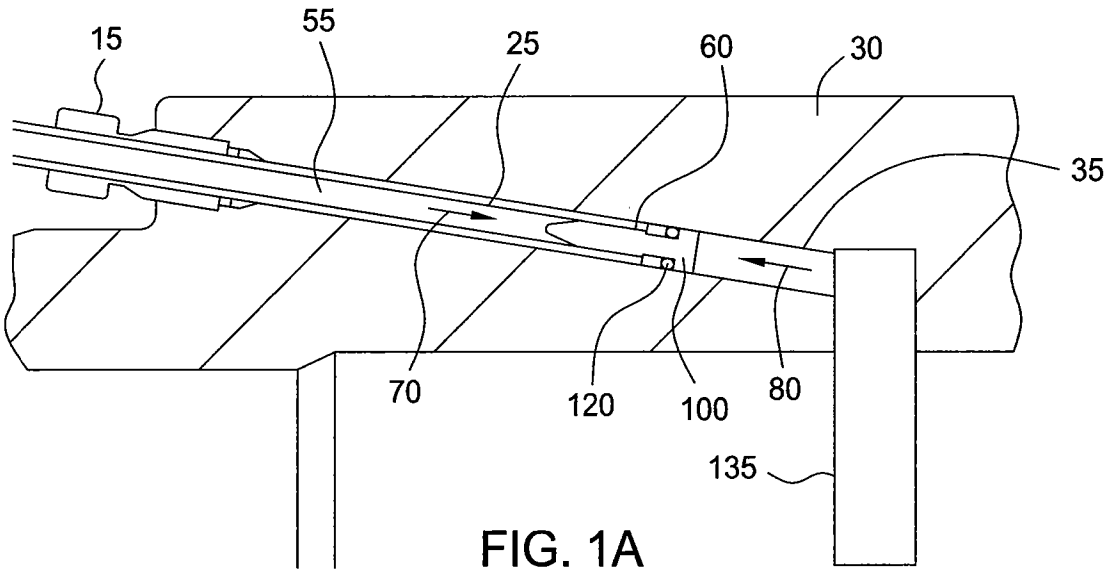
FIG. 1A illustrates a view of a plug assembly disposed in a bore of a control line that is attached to the hydraulic communication device.
Figure 1:
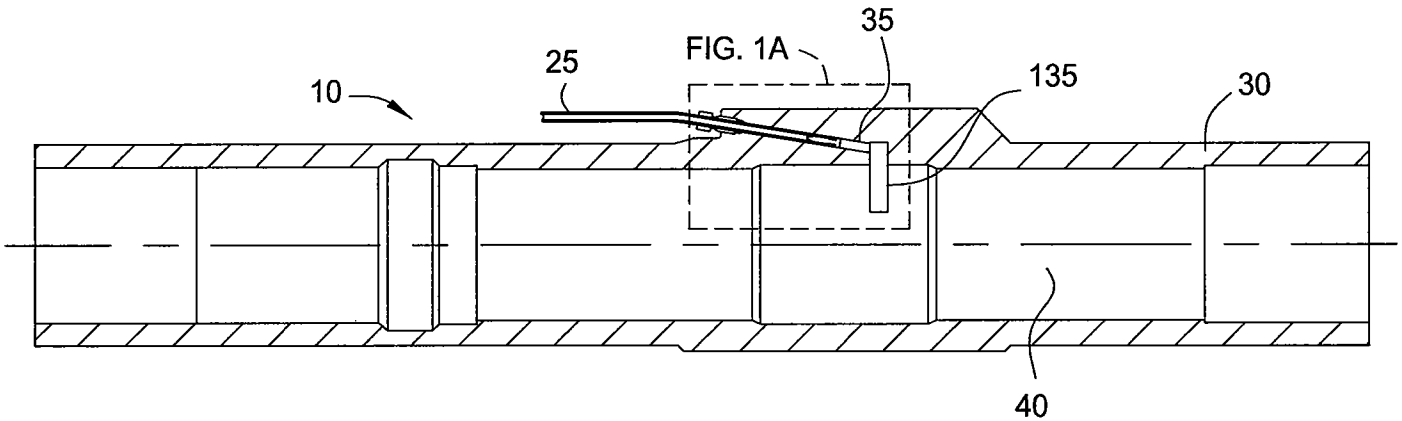
FIG. 1 illustrates a view of a hydraulic communication device.

FIGS. 1 and 1A illustrate views of a hydraulic communication device 10. The device 10 includes a body 30 having a central passageway 40. The central passageway 40 of the device 10 may be in fluid communication with the wellbore (not shown). The device 10 also includes a fluid bore 35 in a wall of the body 30. The bore 35 is configured to receive an end of a control line 25 which is connected to the device 10 by connection members 15. The device 10 further includes a groove 135 formed in the wall of the body 30.

FIG. 1A illustrates a view of a plug assembly 100 (or dart assembly) disposed in a bore 55 of the control line 25. The plug assembly 100 is used to control fluid communication between the bore 55 of the control line 25 and the central passageway 40 of the device 10 by temporality blocking fluid communication therebetween. More specifically, the plug assembly 100 is configured to seal the bore 35 which is between the control line 25 and the central passageway 40 thereby blocking fluid communication therebetween. To create a seal in the bore 35, the plug assembly 100 includes a seal member 120 that engages the bore 35 in the wall of the body 30. The bore 35 is in fluid communication with the groove 135 and the central passageway 40. Since the device 10 may not be used immediately after the device 10 is deployed in the wellbore. The plug assembly 100 provides a means for closing off the device 10 until the device 10 is needed. The plug assembly 100 is configured to be press fit plug assembly that is placed in an end 60 of the control line 25 prior to deploying the device 10 into the wellbore. The control line 25 typically has little or no applied pressure until it is to be used. Thus, the wellbore pressure in the central passageway 40 and bore 35 of the device 10 applies a force on the plug assembly 100 in the direction of direction arrow 80, in order to securely maintain the plug assembly 100 in place within in the control line 25 during isolation. In one embodiment, a shear member, such as 0.010" brass wire, may be attached to the plug assembly 100 and the control line 25 (or the bore 35). The shear member is used to ensure the plug assembly 100 does not dislodge from the control line 25 prematurely. The shear member is configured to shear when a force is applied to the plug assembly 100 in the direction of direction arrow 70. The force required to shear the shear member may be 100-200 psi. After the shear member is sheared, the plug assembly 100 is allowed to be expelled from the control line 25 as described herein.

Figure 2A:
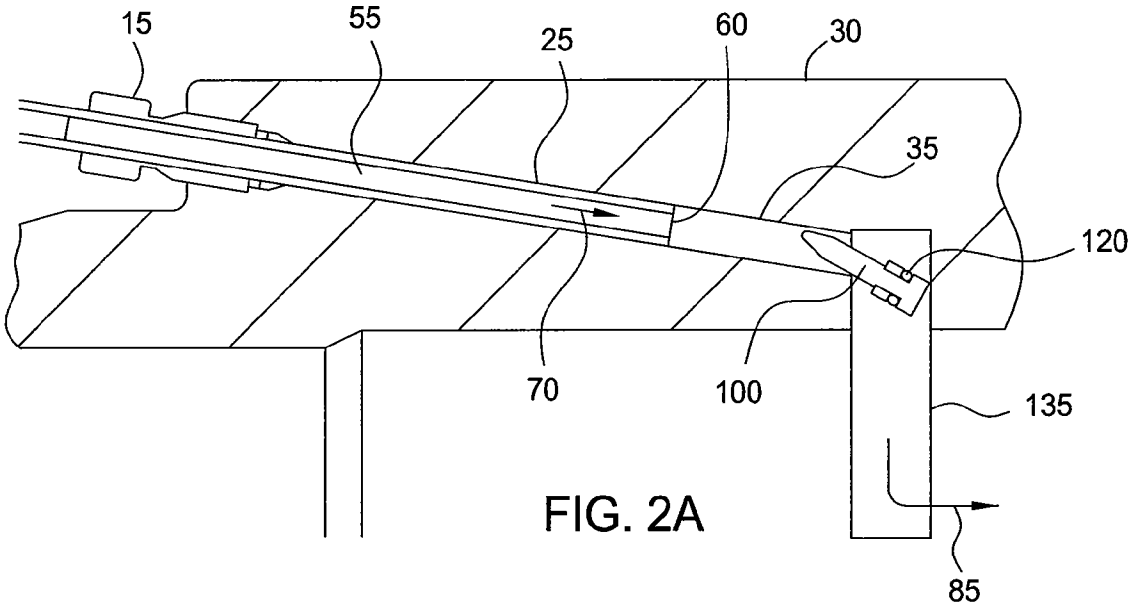
FIG. 2A illustrates a view of the plug assembly removed from the bore of the control line.

The plug assembly 100 is moveable from a first position in which fluid communication between the bore 55 of the control line 25 and the bore 35 of the device 10 is blocked (FIG. 1A), and a second position in which fluid communication between the bore 55 of the control line 25, and the bore 35 of the device 10 is unblocked (FIG. 2A).

Figure 2:
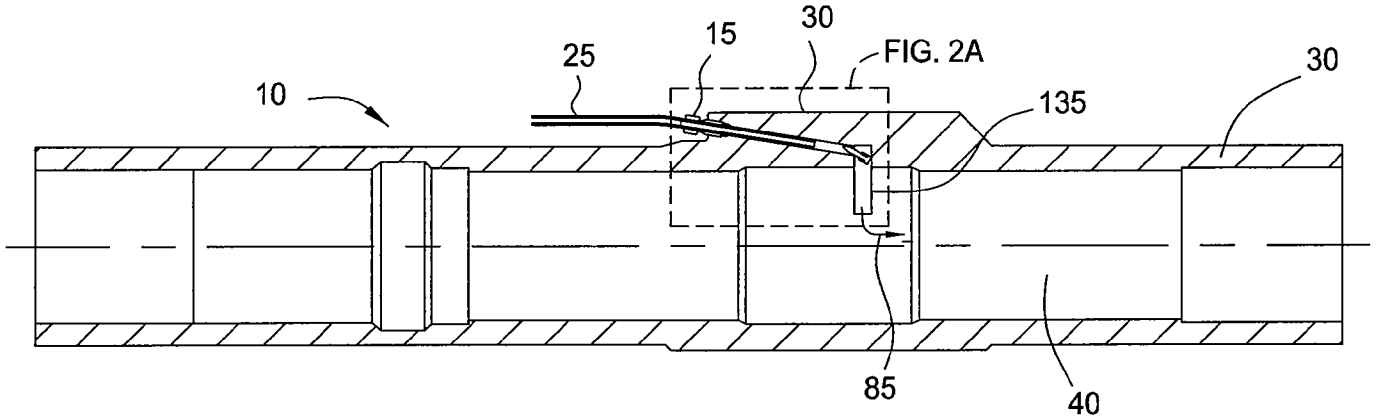
FIG. 2 illustrates a view of the hydraulic communication device.

FIGS. 2 and 2A illustrate views of the hydraulic communication device 10 after the plug assembly 100 has moved from the first position to the second position. As shown, the plug assembly 100 has been removed from the end 60 of the control line 25 and the seal member 120, and the seal member 120 no longer engages the bore 35 in the wall of the body 30. The plug assembly 100 is designed to become wedged within the groove 135. In other words, the groove 135 acts as a catch basket (or holder) for the plug assembly 100 so that the plug assembly 100 is prevented from returning to control line 25 and replugging the control line 25.

To remove the plug assembly 100 from the control line 25, fluid pressure is communicated in the direction of direction arrow 70 through the control line 25 from the surface or an area above the plug assembly 100. When the force applied to the plug assembly 100 in the direction of direction arrow 70 which is generated by the fluid pressure in the control line 25 becomes greater than the force on the plug assembly 100 in the direction of direction arrow 80 which is generated by the wellbore pressure in the device 10, the plug assembly 100 is expelled from the control line 25 and becomes wedged within the groove 135. Thereafter, fluid communication is established between the control line 25 and the central passageway 40 of the device 10. The fluid from the control line 25 flows through the bore 35 in the direction of direction arrow 70, past the plug assembly 100, and into the central passageway 40 of the device 10, as shown by arrow 85 in FIG. 2. The control line 25 may now be used to provide hydraulic control to a subsurface safety valve or to provide chemicals to be injected into the central passageway 40 of the device 10. In one embodiment, an optional stopping device is used to prevent the plug assembly 100 from entering the central passageway 40 of the device 10 after the plug assembly 100 is expelled from the control line 25. The optional stopping device may be located in the body 30 adjacent the groove 135.

Figure 3:
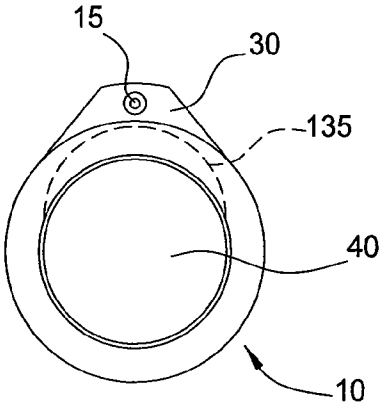
FIG. 3 illustrates an end view of the hydraulic communication device.

FIG. 3 illustrates an end view of the hydraulic communication device 100. As shown, the groove 135 is formed in the wall of the body 30. The groove 135 is configured to receive the plug assembly 100 when the plug assembly 100 is expelled from the control line 25. The groove 135 is also sized to allow fluid from the control line 25 to flow past the plug assembly 100 and into the central passageway 40 of the device 10.

Figure 4:
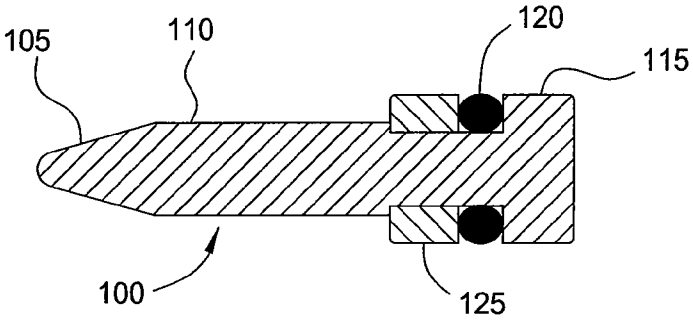
FIG. 4 illustrates a view of the plug assembly.

FIG. 4 illustrates a view of the plug assembly 100. The plug assembly 100 includes a stem portion 110 having an optional tip 105 at one end. The tip 105 is used to guide the plug assembly 100 when the plug assembly 100 is inserted within the control line 25. The other end of the stem portion 110 is attached to a head portion 115. An optional backup ring 125 is disposed in a groove on the stem portion 110. The backup ring 125 is configured to be the contact point between the plug assembly and the end 60 (FIG. 1A) of the control line 25. The seal member 120 is disposed between the backup ring 125 and the head portion 115. The seal member 120 is configured to create a seal in the bore 35. The stem 110 also is a seal when it is pressed into the end of the control line (i.e., first position of the plug assembly). The diameter of the stem portion 110 is sized such that the plug member 100 member fits within the bore 55 of the control line 25. The length of the stem portion 110 is sized such that the plug member 100 becomes wedged within the groove 135 (i.e., second position of the plug assembly).

Figure 5:
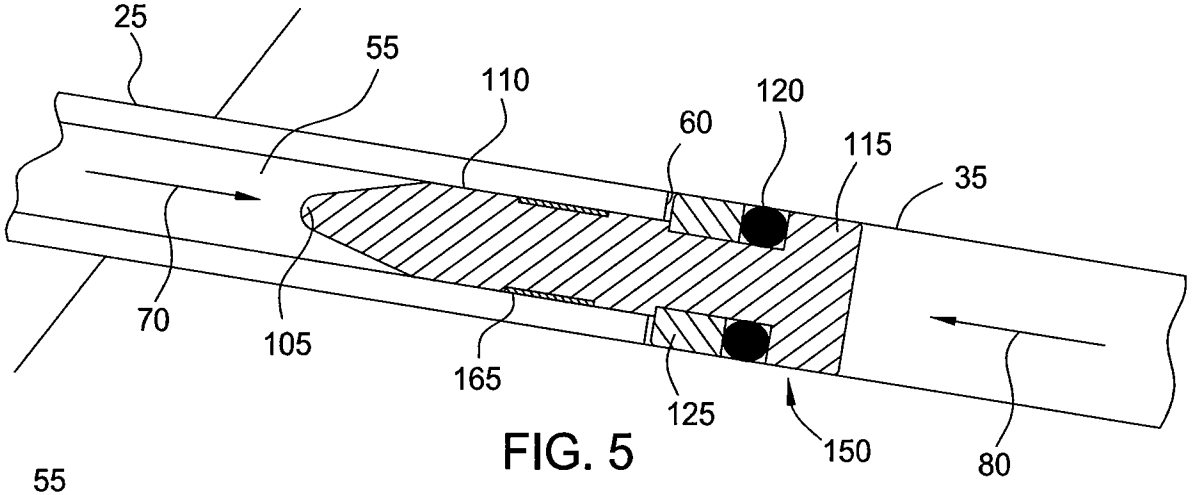
FIG. 5 illustrates a view of a plug assembly disposed in the bore of a control line.
Figure 6:
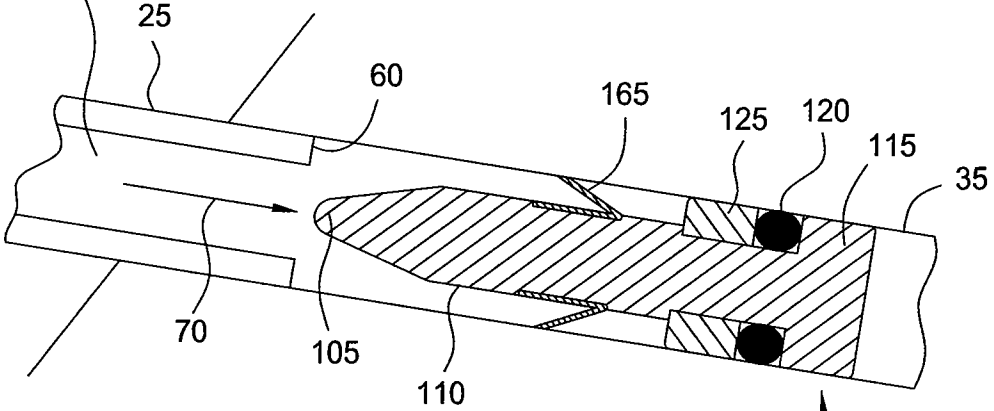
FIG. 6 illustrates a view of the plug assembly removed from the bore of the control line.

FIG. 5 illustrates a view of a plug assembly 150 disposed in the bore 55 of the control line 25. For convenience, the components in the plug assembly 150, that are similar to the components in the plug assembly 100, will be labeled with the same number indicator. The plug assembly 150 is moveable from a first position in which fluid communication between the bore 55 of the control line 25 and the bore 35 of the device 10 is blocked (FIG. 5), and a second position in which fluid communication between the bore 55 of the control line 25 and the bore 35 of the device 10 is unblocked (FIG. 6). The control line 25 typically has little or no applied pressure until it is to be used. Thus, the wellbore pressure in the central passageway 40 and bore 35 of the device 10 applies a force on the plug assembly 150 in the direction of direction arrow 80, in order to securely maintain the plug assembly 100 in place within in the control line 25 during isolation.

The plug assembly 150 includes the stem portion 110 and the head portion 115. The plug assembly 150 further includes a biasing member 165, such as a spring clip, which is disposed on the stem portion 110. In one embodiment, the biasing member 165 may be placed in a groove on the stem portion 110, such that an outer diameter of the biasing member 165 is substantially the same as an outer diameter of the stem portion 110. The biasing member 165 is biased radially outward. The biasing member 165 may grip a wall of the bore 55, which can be used to hold the plug assembly 150 within the control line 25, and the biasing member 165 can also used to prohibit plug assembly 150 from re-entering bore 35 once it is moved into groove 135.

FIG. 6 illustrates a view of the plug assembly 150 removed from the bore 55 of the control line 25. To remove the plug assembly 150 from the control line 25, fluid pressure is communicated in the direction of direction arrow 70 through the control line 25, from the surface or an area above the plug assembly 150. When the force on the plug assembly 150 in the direction of direction arrow 70, which is generated by the fluid pressure in the control line 25, becomes greater than the force on the plug assembly 150 in the direction of direction arrow 80, which is generated by the wellbore pressure in the device 10, and a gripping force generated by the biasing member 165, the plug assembly 150 is expelled from the control line 25. Thereafter, an end of the biasing member 165 extends radially outward into contact with a wall of the bore 35. The biasing member 165 is configured to prevent the plug member 150 from returning to control line 25 and replugging the control line 25. After the plug assembly 150 is removed from the control line 25, it continues to travel out of the bore 35 and into the groove 135. Fluid communication is established between the control line 25 and the central passageway 40 of the device 10. The fluid from the control line 25 flows in the direction of direction arrow 70, past the plug assembly 150 and through the bore 35 of the device 10. The control line 25 may now be used to provide hydraulic control to a subsurface safety valve, or to provide chemicals to be injected into the central passageway 40 of the device 10.

In another embodiment, a check valve (not shown) may be placed in the bore 35 of the hydraulic communication device 10. The check valve is configured to allow fluid flow in the direction indicated by direction arrow 70 and block fluid flow in the direction indicated by direction arrow 80. The check valve may be used in place of the plug assembly 100. The check valve is movable between an opened position and a closed position to allow selective communication between the control line 25 and the central passageway 40. In operation, fluid pressure is communicated in the direction of direction arrow 70 through the control line 25 from the surface or an area above the plug assembly 100. When the force applied to the check valve in the direction of direction arrow 70 becomes greater than the force that keeps the check valve in the closed position, the check valve moves to the opened position. Thereafter, fluid communication is established between the control line 25 and the central passageway 40 of the device 10. The fluid from the control line 25 flows through the bore 35 in the direction of direction arrow 70, past the check valve, and into the central passageway 40 of the device 10, as shown by arrow 85 in FIG. 2. The control line 25 may now be used to provide hydraulic control to a subsurface safety valve or to provide chemicals to be injected into the central passageway 40 of the device 10. After the fluid pressure in the control line 25 becomes less than the force that keeps the check valve in the opened position, the check valve moves to the closed position. The check valve may move between the opened and closed position any number of times during the operation of the device 10.

In one embodiment, a hydraulic communication device is provided. The hydraulic communication device includes a body having a central passageway, and a bore formed in a wall of the body. The bore is in fluid communication with the central passageway, and the bore is configured to receive an end of a control line. The hydraulic communication device further includes a plug assembly disposed in the bore formed in the wall of the body. The plug assembly is movable from a first position in which fluid communication through the bore is blocked, and a second position in which fluid communication through the bore is unblocked.

In one or more embodiments, a portion of the plug assembly is disposed in a control line bore when the plug assembly is in the first position.

In one or more embodiments, the plug assembly includes a stem portion and a head portion.

In one or more embodiments, the stem portion is disposed in the control line and the head portion is disposed in the bore of the body when the plug assembly is in the first position.

In one or more embodiments, the head portion is disposed in a groove formed in the wall of the body when the plug assembly is in the second position.

In one or more embodiments, the plug assembly includes a seal member disposed on the stem portion. The seal member is configured to create a seal with the bore formed in the wall of the body when the plug assembly is in the first position.

In one or more embodiments, the plug assembly includes a biasing member disposed on the stem portion.

In one or more embodiments, the biasing member is in a retracted position when the plug assembly is in the first position and the biasing member is in the extended position when the plug assembly is in the second position.

In one or more embodiments, an end of the biasing member engages a wall of control line when the plug assembly is in the first position.

In one or more embodiments, an end of the biasing member engages the bore in the wall of the body when the plug assembly is in the second position.

In one or more embodiments, a groove is formed in the wall of the body between the bore and the central passageway.

In one or more embodiments, the groove is configured to receive the plug assembly when the plug assembly is in the second position.

In another embodiment, a method of activating a hydraulic communication device in a wellbore is provided. The hydraulic communication device is attached to a control line. The method includes the step of placing the hydraulic communication device in the wellbore. The hydraulic communication device includes a body with a central passageway. The method further includes the step of closing fluid communication between the control line and the central passageway by placing a plug assembly therebetween. The method also includes the step of opening fluid communication between the control line and the central passageway by moving the plug assembly. Additionally, the method includes the step of pumping fluid through the control line, and into the central passageway of the body of the hydraulic communication device.

In one or more embodiments, the plug assembly includes a seal member that is configured to create a seal with the bore formed in the wall of the body when the plug assembly is partially disposed within the control line.

In one or more embodiments, a groove in a wall of the body is configured to hold the plug assembly when the plug assembly is expelled from the control line.

In one or more embodiments, the plug assembly includes a biasing member that is configured to prevent the plug assembly from returning to the control line after being expelled from the control line.

In a further embodiment, a plug assembly is provided. The plug assembly is used with a hydraulic communication device that is attached to a control line. The plug assembly includes a stem portion having a first end and a second end. The plug assembly further includes a head portion attached to the first end of the stem portion. Additionally, the plug assembly includes a seal member disposed around the first end of the stem portion. The seal member is configured to create a seal with an end of the control line when the plug assembly is partially disposed within the control line.

In one or more embodiments, a tip portion is disposed at the second end of the stem portion.

In one or more embodiments, a backup ring member disposed on the stem portion. The backup ring member is configured to engage the end of the control line when the plug assembly is partially disposed within the control line.

In one or more embodiments, a biasing member is configured to prevent the plug assembly from returning to the control line after the plug assembly is expelled from the control line.

In yet another embodiment, a method of activating a hydraulic communication device in a wellbore is provided. The method includes the step of attaching a control line to the hydraulic communication device. The method also includes the step of placing the hydraulic communication device in the wellbore. The hydraulic communication device includes a body with a central passageway. The method further includes the step of positioning a plug assembly to block fluid communication between the control line and the central passageway. The method also includes the step of moving the plug assembly to open fluid communication between the control line and the central passageway. Additionally, the method includes the step of pumping fluid through the control line, and into the central passageway of the body of the hydraulic communication device.

While the foregoing is directed to embodiments of the present invention, other and further embodiments of the invention may be devised without departing from the basic scope thereof, and the scope thereof is determined by the claims that follow.

The invention claimed is:

1. A hydraulic communication device connected to a surface of a wellbore by a control line comprising:

a body having a central passageway and a bore formed in a wall of the body, the bore is in fluid communication with the central passageway, and the bore is configured to receive an end of the control line;

a groove formed as a recess in the wall of the body between the bore and the central passageway; and a plug assembly disposed in the bore formed in the wall of the body, the plug assembly movable from a first position in which fluid communication through the bore is blocked and movable to a second position in which fluid communication through the bore is unblocked, wherein:

the groove is configured to receive the plug assembly when the plug assembly is in the second position, the plug assembly includes a stem portion and a head portion, and the stem portion is disposed in the control line and the head portion is disposed in the bore of the body when the plug assembly is in the first position.

2. The communication device of claim 1, wherein a portion of the plug assembly is disposed in a bore of the control line when the plug assembly is in the first position.

3. The communication device of claim 1, wherein the head portion is disposed in the groove formed in the wall of the body when the plug assembly is in the second position.

4. The communication device of claim 1, wherein the plug assembly includes a seal member disposed on the stem portion, the seal member being configured to create a seal with the bore formed in the wall of the body when the plug assembly is in the first position.

5. The communication device of claim 1, wherein the plug assembly includes a biasing member disposed on the stem portion.

6. The communication device of claim 5, wherein the biasing member is in a retracted position when the plug assembly is in the first position and the biasing member is in an extended position when the plug assembly is in the second position.

7. The communication device of claim 6, wherein an end of the biasing member engages a wall of control line when the plug assembly is in the first position.

8. The communication device of claim 6, wherein an end of the biasing member engages the bore in the wall of the body when the plug assembly is in the second position.

9. The communication device of claim 1, wherein the plug assembly is releasably engaged with the control line.

10. The communication device of claim 9, further comprising a shearable member for releasably engaging the plug assembly to the control line.

11. The communication device of claim 9, wherein the plug assembly forms an interference fit with the control line.

12. The communication device of claim 1, wherein the plug assembly is engaged with the control line when the plug assembly is in the first position.

13. The communication device of claim 1, wherein one side of the plug assembly is exposed to the control line and a second side of the plug assembly is exposed to the central opening when the plug assembly is in the first position.

14. A method of activating a hydraulic communication device connected to a surface of a wellbore by a control line, the method comprising:

placing the hydraulic communication device in the wellbore, the hydraulic communication device having a body with a central passageway, coupling the control line to a bore formed in a wall of the body;

closing fluid communication between the control line and the central passageway by placing a plug assembly in engagement with the control line and the bore;

opening fluid communication between the control line and the central passageway by moving the plug assembly to a recessed groove formed in the wall of the body; and pumping fluid through the control line and into the central passageway of the body of the hydraulic communication device, wherein the plug assembly includes a biasing member that is configured to prevent the plug assembly from returning to the control line after being moved.

15. The method of claim 14, wherein the plug assembly includes a seal member that is configured to create a seal with the bore formed in the wall of the body when the plug assembly is partially disposed within the control line.

16. A plug assembly for use with a hydraulic communication device that is connected to a surface of a wellbore by a control line, the plug assembly comprising:

a stem portion having a first end and a second end;

a head portion attached to the first end of the stem portion;

a backup ring member disposed on the stem portion, the backup ring member being configured to engage the end of the control line when the plug assembly is partially disposed within the control line;

a seal member disposed around the first end of the stem portion and in contact with the backup ring member, the seal member being configured to block fluid flow through the control line when the plug assembly is partially disposed within the control line; and a biasing member that is configured to prevent the plug assembly from returning to the control line after the plug assembly is expelled from the control line.

17. The plug assembly of claim 16, wherein a tip portion is disposed at the second end of the stem portion.

18. A hydraulic communication device comprising:

a body having a central passageway and a bore formed in a wall of the body, the bore is in fluid communication with the central passageway, and the bore is configured to receive a first end of a control line, wherein a second end of the control line is outside of the bore;

a groove formed as a recess in the wall of the body between the bore and the central passageway; and a plug assembly disposed in the bore formed in the wall of the body, the plug assembly movable from a first position in which fluid communication through the bore is blocked and movable to a second position in which fluid communication through the bore is unblocked, wherein the groove is configured to receive the plug assembly when the plug assembly is in the second position, wherein:

the plug assembly includes a stem portion and a seal member disposed on the stem portion, and the seal member is configured to create a seal with the bore formed in the wall of the body when the plug assembly is in the first position.

19. A hydraulic communication device connected to a surface of a wellbore by a control line comprising:

a body having a central passageway and a bore formed in a wall of the body, the bore is in fluid communication with the central passageway, and the bore is configured to receive an end of the control line;

a groove formed as a recess in the wall of the body between the bore and the central passageway; and a plug assembly disposed in the bore formed in the wall of the body, the plug assembly movable from a first position in which fluid communication through the bore is blocked and movable to a second position in which fluid communication through the bore is unblocked, wherein:

the groove is configured to receive the plug assembly when the plug assembly is in the second position, the plug assembly includes a stem portion and a head portion, and the plug assembly includes a seal member disposed on the stem portion, the seal member being configured to create a seal with the bore formed in the wall of the body when the plug assembly is in the first position.

20. The communication device of claim 19, wherein a portion of the plug assembly is disposed in a bore of the control line when the plug assembly is in the first position.

21. The communication device of claim 19, wherein the head portion is disposed in the groove formed in the wall of the body when the plug assembly is in the second position.

22. The communication device of claim 19, wherein one side of the plug assembly is exposed to the control line and a second side of the plug assembly is exposed to the central opening when the plug assembly is in the first position.

* * * * *